US005172935A

United States Patent [19]

Marona et al.

[11] Patent Number: 5,172,935

[45] Date of Patent: Dec. 22, 1992

[54] SKI POLE HAND GRIP WITH GOGGLE SCRAPER

[76] Inventors: Robert Marona, 81 Charter Cir., Ossinger, N.Y. 10562; Anthony Sheehan, 91 Brook St., Croton, N.Y. 10520; David Oxton, Scarborough Manor, Scarborough, N.Y. 10510

[21] Appl. No.: 740,102

[22] Filed: Aug. 5, 1991

[51] Int. Cl.[5] ..... A63C 11/18; G02C 13/00

[52] U.S. Cl. ..... 280/821; 15/245; 280/813

[58] Field of Search ..... 280/813, 821, 822, 809; 15/245, 227, 236.01, 236.02

[56] References Cited

U.S. PATENT DOCUMENTS

| | | | |
|---|---|---|---|
| 2,517,247 | 8/1950 | Seley | 15/236.02 X |
| 2,770,826 | 11/1956 | Curfman | 15/236.02 X |
| 3,929,345 | 12/1975 | Nasby et al. | 280/813 |
| 4,000,909 | 1/1977 | Coak | 280/813 |
| 4,129,312 | 12/1978 | Löffelholz | 280/813 |
| 4,145,062 | 3/1979 | Stiemert | 280/813 |
| 4,221,393 | 9/1980 | Donahue | 280/813 |
| 4,573,710 | 3/1986 | Ford | 280/813 |
| 4,718,138 | 1/1988 | Brown et al. | 280/813 X |
| 4,757,556 | 7/1988 | Girard | 15/227 X |
| 4,827,557 | 5/1989 | Siler, Jr. et al. | 280/813 X |
| 4,881,291 | 11/1989 | Ellis | 15/236.01 |

FOREIGN PATENT DOCUMENTS

| | | | |
|---|---|---|---|
| 1597837 | 9/1981 | United Kingdom | 15/245 |

*Primary Examiner*—Charles A. Marmor
*Assistant Examiner*—Michael Mar
*Attorney, Agent, or Firm*—Dennis M. Flaherty

[57] ABSTRACT

A ski pole hand grip is provided with a straight edge for scraping ice and snow off of the surface of a goggle lens. The hand grip has a main body of conventional form with an upper and lower flange for preventing slippage of the skier's hand off of the ends of the hand grip. An extension made of the same material as the hand grip is integrally connected to the upper flange and extends in the rearward direction. The extension decreases in width and height in the rearward direction, terminating in a straight edge suitable for scraping ice and snow from the goggle lens. The straight edge has an acute angle profile. The hand grip with goggle scraper is a unitary piece made from plastic or rubber. Preferably the piece is formed by injection molding of a plastic material.

6 Claims, 1 Drawing Sheet

SKI POLE HAND GRIP WITH GOGGLE SCRAPER

FIELD OF THE INVENTION

The present invention relates to ice scrapers for removing ice and snow from the goggle lenses of a skier. More particularly, the invention relates to an ice scraper which is integrally formed with the hand grip of a ski pole.

BACKGROUND OF THE INVENTION

When a skier encounters certain types of weather conditions, a build-up of ice or snow can accumulate on the lenses of the skier's goggles. This ice or snow must be removed prior to the skier initiating a run down the ski slope to ensure that the skier's vision is unimpaired, thereby enabling the skier to safely navigate the trail.

In the past, skiers have cleaned ice from their goggle lenses by rubbing or wiping the outer surface of the lenses with a bare or gloved finger or by scraping the lens surfaces with a small plastic handheld ice scraper consisting of a handle for holding and a straight edge for scraping. The first method is unsatisfactory because complete removal of the ice or snow on the lens surface is difficult to achieve. The second method is unsatisfactory in that a tiny plastic ice scraper must be stored in a pocket and then taken out when needed. Such an instrument is difficult to retrieve from a pocket and also is easily lost or misplaced.

In addition, it is known to remove snow from ski boots using a bootscraper attached to a ski pole. By attaching the scraper to the pole, the inconvenience of storing and retrieving a hand scraper is avoided. Such boot scrapers are disclosed in U.S. Pat. Nos. 4,000,909, 4,129,312, 4,145,062, 4,221,393, 4,573,710 and 4,718,138. However, such scrapers are specifically designed for scraping snow off of ski boots and are wholly unsuitable for use as a scraper for scraping ice and snow off the goggle lenses.

BRIEF SUMMARY OF THE INVENTION

It is an object of the present invention to overcome the disadvantages of the aforementioned prior art. In particular, it is an object of the invention to provide a utensil which can be conveniently used to scrape snow and ice from the surface of a goggle lens.

Another object of the invention is to provide a goggle scraper which is securely attached to the ski pole and readily accessible to the skier. Ideally the skier can use the scraper without removing his hand from the ski pole hand grip.

A further object of the invention is to provide skiers with a goggle scraper which is impossible to lose or misplace during skiing.

Yet another object of the invention is to provide a ski pole hand grip having a goggle scraper which lends an "aerodynamic" appearance to the design.

A further object of the invention is to incorporate a goggle scraper in a ski pole in a manner which is simple and inexpensive. In particular, an object of the invention is to minimize the cost of manufacture for such a ski pole by providing a hand grip having a goggle scraper integrally formed therewith.

The foregoing objects of the invention are accomplished in accordance with the preferred embodiment by integrally forming the goggle scraper as part of the ski pole hand grip. The hand grip can be made of rubber, plastic or any other suitable material.

In accordance with the preferred embodiment of the invention, the ski pole hand grip has a wing-like extension integrally formed thereon. The wing-like extension terminates in a sharp straight edge which is used to scrape the surface of the goggle lens. The wing-like extension extends rearward with the straight edge facing toward the user. Thus the goggle scraper can be conveniently used by the skier without removing his hand from the hand grip, by simply raising his hand level with the goggle lens, placing the straight edge flush against the lens surface and then sliding the straight edge across the lens surface with up-and-down reciprocating movements.

BRIEF DESCRIPTION OF THE DRAWINGS

The preferred embodiment of the invention will be described in detail hereinafter with specific reference to the drawings, wherein.

DETAILED DESCRIPTION OF THE PREFERRED EMBODIMENT

Figure 1:
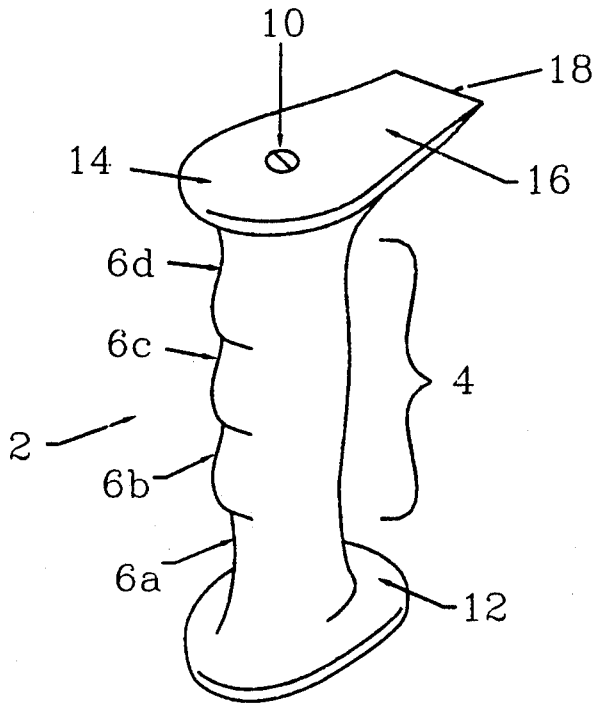
FIG. 1 is a perspective view of the ski pole hand grip with goggle scraper in accordance with the preferred embodiment of the invention.

As shown in FIG. 1, the ski pole hand grip 2 in accordance with the preferred embodiment of the invention is a unitary molded piece of plastic, rubber or other suitable material. Preferably the hand grip is manufactured in a single step, for example, by injection molding.

The outer shape of the main body 4 of hand grip 2 is ergonomically designed to conform to the shape of the fingers and palm of the hand holding the hand grip. At the forward surface of the main body 4, four curved grooves 6*a* through 6*d* are provided. Each groove is designed to receive a corresponding finger of a hand when the hand grip is held.

The outer side and rear surfaces of the main body are designed to conform to the shape of the palm of the hand. The rear surface of the main body 4 is also provided with an array of parallel spaced narrow grooves 8 (best seen in FIG. 2). This grooved surface improves the skier's ability to grip the handle with a gloved hand without slippage.

As is conventional, the hand grip in accordance with the invention is provided with a cylindrical bore (not shown) for receiving the end of the ski pole P. The hand grip is secured to the ski pole by way of a screw 10. Alternatively, the hand grip could be glued to the ski pole.

The bottom of the hand grip 2 has a lower flange 12 integrally connected to one end of the main body 4. Flange 12 provides support to the base of the hand of the skier, helping the skier to push off with his hands to control his direction and speed. The other end of the main body has an upper flange 14 integrally connected thereto. Flange 14 blocks sliding of the skier's hand in an upward direction, that is, off of the ski pole and facilitates lifting of the poles.

The goggle scraper 16 is integrally connected to the upper flange 14 and extends generally in the rearward direction, but in addition curves gently upward to lend an "aerodynamic" appearance to the design. The thickness of the goggle scraper extension decreases gradually in the rearward direction, but has a thickness sufficient to ensure its structural strength. Also the width of the goggle scraper extension decreases gradually in the rearward direction.

The goggle scraper extension terminates in a straight edge 18 suitable for scraping ice from the surface of a goggle lens. The straight edge 18 has an acute angle cross section. Naturally the hand grip is made of a durable plastic o rubber material, which material when formed into the straight edge of the goggle scraper resists deformation, yet will not scratch the surface of the goggle lens.

Figure 2:
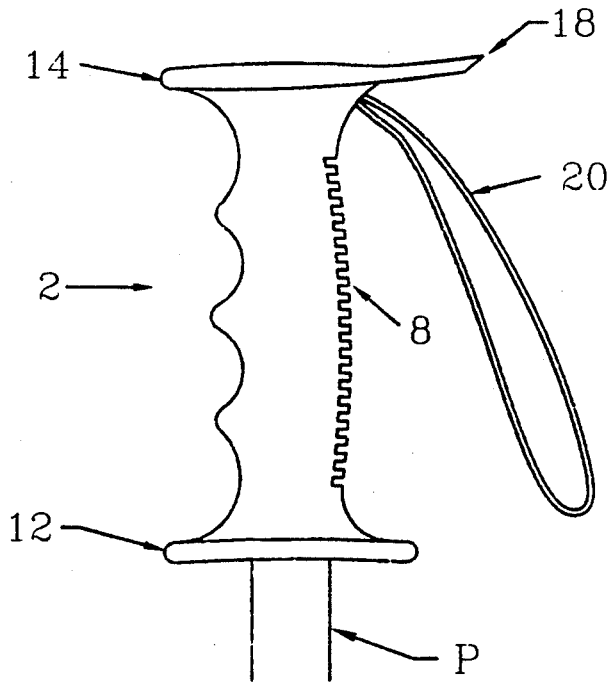
FIG. 2 is a side view of the ski pole hand grip with goggle scraper in accordance with the preferred embodiment of the invention.

FIG. 2 shows a wrist strap 20 which is a loop of woven fabric, leather or plastic having its two ends secured to the hand grip. This strap is adjustable and can be placed around the skier's wrist and tightened to prevent the ski pole from being separated from the skier in the event that the skier falls and loses his or her grip on the ski pole handle. The wrist strap forms no part of the present invention.

The foregoing preferred embodiment of the invention is disclosed for illustrative purposes only. It is apparent to a practitioner of ordinary skill in the art that various modifications could be made without departing from the spirit and scope of the following claims.

What is claimed is:

1. A ski pole hand grip comprising handle means adapted to be gripped by a human hand and means for scraping integrally connected to said handle means, said handle means and said scraping means being formed of a unitary piece of material, said handle means having means for receiving an end of a ski pole and seating means for forming a plurality of seats on a forward portion of said handle means for receiving a plurality of fingers when said hand grip is held in a user's hand said handle means having a main body with first flange means integrally connected to a top end thereof, said scraping means comprises an extension integrally formed with said first flange means and extending rearwardly away from said seating means and overlying the thumb of said hand, and said scraping means having a cross-sectional area which decreases in a rearwardly direction and which terminates in a rearward straight edge.

2. The ski pole hand grip as defined in claim 1, wherein said straight edge has an acute angle profile.

3. The ski pole hand grip as defined in claim 1, wherein said hand grip is made of plastic material.

4. The ski pole hand grip as defined in claim 1, wherein said hand grip is made rubber material.

5. The ski pole hand grip as defined in claim 1, wherein said main body further comprises a bottom end and a second flange means integrally connected to said bottom end of said main body.

6. The ski pole hand grip as defined in claim 5, wherein said extension of said scraping means has a height and a width which both decrease in a direction away from said top flange means, said extension terminating at said straight edge.

* * * * *